United States Patent [19]

Linder

[11] Patent Number: 4,469,058

[45] Date of Patent: Sep. 4, 1984

[54] IGNITION ARRANGEMENT FOR INTERNAL COMBUSTION ENGINE

[75] Inventor: Ernst Linder, Muehlacker, Fed. Rep. of Germany

[73] Assignee: Robert Bosch GmbH, Stuttgart, Fed. Rep. of Germany

[21] Appl. No.: 427,274

[22] Filed: Sep. 29, 1982

[30] Foreign Application Priority Data

Jun. 28, 1982 [DE] Fed. Rep. of Germany ..... 3224048

[51] Int. Cl.[3] ..... F02B 9/08; F02P 19/00

[52] U.S. Cl. ..... 123/145 A; 123/254; 123/281

[58] Field of Search ..... 123/549, 145 A, 254, 123/557, 255, 281

[56] References Cited

U.S. PATENT DOCUMENTS

| | | | |
|---|---|---|---|
| 1,462,514 | 7/1923 | Lowe | 123/254 |
| 1,641,421 | 9/1927 | French | 123/145 A |
| 3,648,669 | 3/1972 | Rank | 123/145 A |

FOREIGN PATENT DOCUMENTS

| | | | |
|---|---|---|---|
| 1382697 | 11/1964 | France | 123/145 A |

*Primary Examiner*—Ronald B. Cox

*Attorney, Agent, or Firm*—Michael J. Striker

[57] ABSTRACT

An incandescent ignition arrangement for an internal combustion engine is combined with a fuel-injection device and has an ignition chamber formed as an annular space coaxial with and surrounding the fuel-injection device, an overflow passage rising toward a reference plane extending normal to the longitudinal axis of the fuel-injection device and having a component which extends tangentially to a periphery of the annular space and is open into the latter, and the overflow passage extends to the reference plane at an angle selected such that an extension of the axis of the overflow passage lies inside a fuel injected from the fuel-injection device, and the arrangement has an electrically heatable ignition element lying inside the contour of the ignition chamber.

15 Claims, 3 Drawing Figures

IGNITION ARRANGEMENT FOR INTERNAL COMBUSTION ENGINE

BACKGROUND OF THE INVENTION

The present invention relates to an incandescent ignition arrangement for an internal combustion engine.

Incandescent ignition arrangements for internal combustion engines are known in the art. A known incandescent ignition arrangement is combined with a fuel-injection device and has an ignition chamber coaxial with the latter and having at least one overflow passage communicating the ignition chamber with a main combustion chamber and an electrically heatable ignition element. Such an incandescent ignition arrangement is disclosed, for example, in French Pat. No. 1,382,697. The ignition arrangement disclosed in this patent has at its one end an open cylindrical chamber and an electrically heatable ignition element formed as a wire coil and arranged inside the ignition chamber. An injection device with which the fuel is injected into the internal combustion engine is coaxial with the ignition chamber and injects fuel into a main combustion chamber of the internal combustion engine. This main combustion chamber is connected with the ignition chamber via a passage which is simultaneously directed to the injection device. During injection fuel droplets are separated from the injected stream. A part of these droplets is supplied during a compression stroke of the internal combustion engine together with air which is pressed in the ignition chamber, in this chamber. Because of the cylindrical design of the ignition chamber and the cylindrical arrangement of the wire coil, cool fuel drops supplied in the ignition chamber act upon the incandescent ignition element. These drops are evaporated by the ignition element to gas, mixed with air and finally inflamed. Other droplets are gasified and ignited with the aid of flames produced by the ignition element. Because of this the combustion inside the ignition chamber takes place slowly, with the result that only a great ignition chamber volume is suitable for obtaining a sufficiently energy-efficient and grazing ignition flame. A great ignition chamber volume results in great overflow losses between the main combustion chamber and the ignition chamber. A great ignition chamber volume and the corresponding voluminous incandescent ignition element require, for heating during the start of the internal combustion engine, a great quantity of electrical energy and long heating times.

SUMMARY OF THE INVENTION

Accordingly, it is an object of the present invention to provide an incandescent ignition arrangement for an internal combustion engine which avoids the disadvantages of the prior art.

In keeping with these objects and with others which will become apparent hereinafter, one feature of the present invention resides in an incandescent ignition arrangement for an internal combustion engine having a main combustion chamber and a fuel-injection device, which has an ignition chamber with at least one overflow passage communicating the ignition chamber with the main combustion chamber, wherein the ignition chamber is formed as an annular space coaxial with and surrounding the fuel-injection device, the overflow passage rises toward a reference plane extending normal to the longitudinal axis of the fuel-injection device and has a component which extends tangentially to a periphery of the annular space and is open into the latter, the overflow passage extends to the reference plane at an angle selected so that an extension of the axis of the overflow passage lies inside fuel ejected from the fuel-injection device, and an electrically heatable incandescent ignition element lies inside a contour of the ignition chamber.

When the incandescent ignition arrangement is designed in accordance with these features, it produces a ring-shaped closed flow of the mixture to be ignited, which flows inside the ignition chamber with high circumferential speed along the ignition element, and because of the special arrangement of this element is practically not braked by it. This flow improves and accelerates the preparation of the mixture, the preparation involving substantially the entire quantity of the mixture enclosed in the ignition chamber, and this further accelerates after the ignition the flame generation and the flame expansion inside the ignition chamber, so that a faster and higher pressure increase takes place in the same, and as a result of this faster ignition flames emit from the overflow passage. Thereby the volume of the ignition chamber can be selected smaller and the overflow losses can be reduced. This makes possible the construction of the internal combustion engine with smaller main combustion chamber and higher fuel economizing compression characteristics.

Another feature of the present invention is that the overflow passage is inclined relative to the reference plane, so that an ignition flame emerging therefrom has, relative to the longitudinal axis of the fuel-injection device, a rotary direction corresponding to a direction of rotation of the fuel mixture in the main combustion chamber. When the ignition arrangement is designed in accordance with these features, the increased kinetic energy of all ignition flames is made useful for maintenance and excitation of a fast twist stream inside the main combustion chamber, which is a condition for a detonation-free combustion with further increased compression characteristics.

Still another feature of the present invention is that a plurality of overflow passages are distributed around the longitudinal axis of the ignition chamber. This has the advantage a great flame surface develops, and a great part of the mixture accommodated in the main combustion chamber of the internal combustion engine is involved for faster ignition and faster pressure increase.

A further feature of the present invention is that a ratio between a sum of the cross-sections of the overflow passages and the volume of the ignition chamber is smaller than 0.06 $cm^{-1}$. The cross-section which is selected in accordance with these features for the overflow passages has the advantage that, after the incandescent ignition relative to the main combustion chamber in the ignition chamber a greater pressure increase takes place. This provides for a strong acceleration of combustion gases and thereby grazing ignition flames emerging from the overflow passages and coming into the main combustion chamber.

Still a further feature of the present invention is that the overflow passages are arranged so that the ignition flames emerging therefrom support a twist stream of fuel mixture which takes place in the main combustion chamber. When the overflow passages are designed in accordance with these features, the gas movement, such as for example a twist stream in the main combustion chamber of the internal combustion engine, is supported or excited by the ignition flames and has the advantage that an accelerated and improved flame expansion takes place in the main combustion chamber.

Yet another feature of the present invention is that the electrically heatable incandescent ignition element includes at least one resistance member anchored in an insulator. The thus formed ignition element is manufactured economically and assumes an inner contour of the ignition chamber which practically does not distort the centrifuging stream.

An additional feature of the present invention is that an electrically and heat insulated pipe surrounding the fuel-injection device is provided, and the resistance member is arranged on a periphery of this pipe. In this case the construction of the ignition arrangement is especially economical, inasmuch as the pipe arranged around the injection device is formed as a support for the resistance.

A ring-shaped closed heat-insulating layer may be arranged at a height of the resistance member between the above mentioned pipe and the fuel-injection device. In this construction, despite the arrangement of the resistance on the insulating pipe, a little quantity of heat is transferred to the injection device, so that it remains free from unacceptable overheating.

A further pipe of a poor insulating material may be arranged between the first-mentioned pipe and the fuel-injection device and composed, for example, of rust-free steel. These features improve the heat insulation in direction of the injection device further, so that a further advantage is that there is a considerable economy of electric heating energy because of reduced heat conduction from the resistance in direction of the fuel-injection device.

A further feature of the present invention is that the ignition chamber is partially formed directly in the cylinder head of the internal combustion engine and partially formed by a ring-shaped part arranged in the cylinder head concentrically to the fuel-injection device. These features provide for space-saving construction and thereby a good accommodation in the internal combustion engine with a small main combustion chamber.

Finally, one more feature of the present invention is that the above-mentioned further pipe is provided at its end facing toward the main combustion chamber with a flange, the ring-shaped part of the internal combustion engine has an opening which is concentric with the flange and sealingly borders the latter, the overflow passage being provided in the ring-shaped part. In this case, the ignition flames run at a distance from the fuel-injection device and facing to the main combustion chamber of the internal combustion engine, where undesirable heat transfer to the injection device is eliminated. Because of the sealing of the fuel-injection device relative to the ring-shaped part which is the component of the ignition chamber from which the pipe surrounding the injection device extends, a passage of combustion gases between the injection device and the ring-shaped part of the ignition chamber is eliminated. Thereby the free end of the fuel-injection device is protected from overheating.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
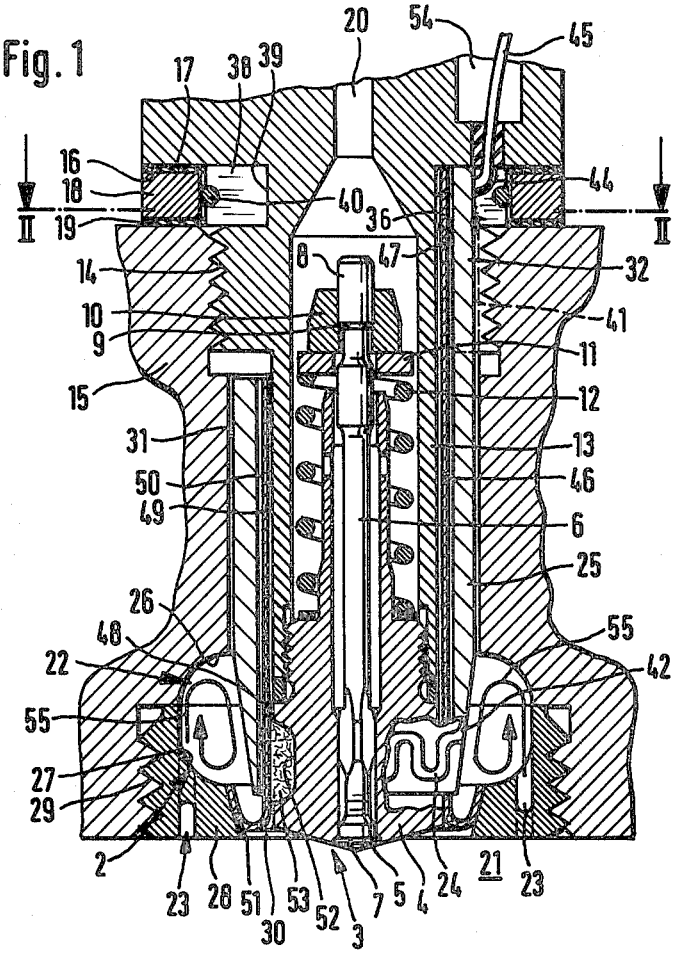
FIG. 1 is a view showing a longitudinal section of an ignition arrangement in accordance with the present invention.
Figure 2:
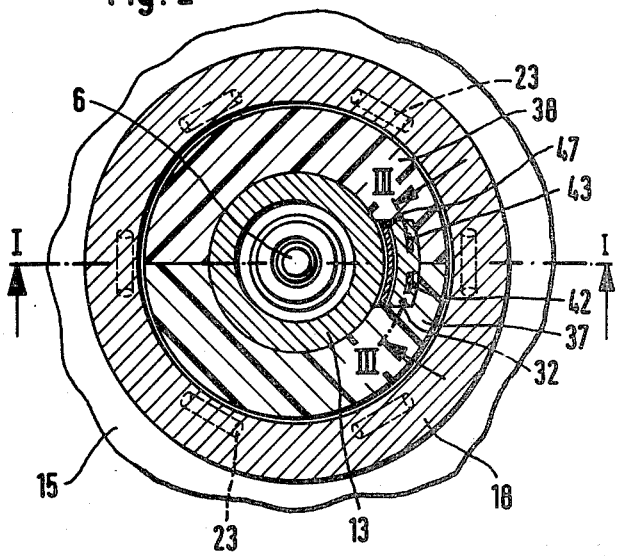
FIG. 2 is a view showing a cross-section of the ignition arrangement taken along the line 2—2 in FIG. 1.
Figure 3:
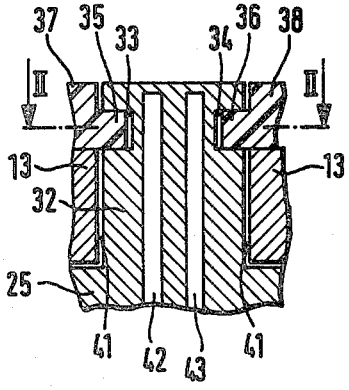
FIG. 3 is a view showing a fragment of the inventive ignition arrangement of FIG. 1, in a side view.

An incandescent ignition arrangement 2 is combined with a fuel-injection device 3. The fuel-injection device is formed in a known manner and has a nozzle body 4 with a nozzle opening 5, a nozzle needle 6 displaceable in longitudinal direction of the nozzle body 4. The nozzle body 6 has a sealing cone 7 directed against the nozzle opening 5 and a flange 9 formed at an end 8 which is opposite to the sealing cone 7. It also has a holding ring 10 engaging under the flange 9, a disk 11 adjacent to the holding ring 10 and surrounding the nozzle needle 6, and a closing spring 12 arranged between the disk 11 and the nozzle body 4. The closing spring 12 is inserted in a prestressed condition, presses against the disk 11, the ring 10, and finally the flange 9 of the nozzle needle 6. Thereby, via the nozzle needle 6, the sealing cone 7 is pulled against the nozzle opening 5 for closing the injection nozzle 3.

The fuel-injection nozzle 3 is screwed in a nozzle holder 13. The nozzle holder 13 has a thread 14 with which it is screwed in a cylinder head 15 of an internal combustion engine. The nozzle holder 13 has an abutment face 16 directed against the cylinder head. A first sealing ring 17, an intermediate ring 18 and a second sealing ring 19 are arranged between the abutment face 16 and the cylinder head 15. A connecting opening 20 leads into the interior of the nozzle holder 13 and is connected via a not shown conduit with an injection pump of known construction. When the pump pumps through the connecting opening 20 a fuel into the nozzle holder 13, a pressure is formed in the same and acts against the nozzle needle 13 so that when the latter reaches a predetermined height, the force of the closing spring 12 is overcome. Thereby the needle nozzle 6 displaces and a gap is formed between the nozzle opening 5 and the sealing cone 7. The fuel in form of a conical annular jet exits through the gap and sprays in a main combustion chamber 21 which borders at the cylinder head 15 and forms a component of an internal combustion chamber. The annular jet disintegrates into fuel droplets. The fuel can be composed of methanol, ethanol, benzine, benzene or diesel oil, or a mixture of these liquids.

The incandescent ignition arrangement 2 has an annular ignition chamber 22, at least one overflow passage 3 which is inclined to a plane in which the annular ignition chamber lies and also communicates the ignition chamber 22 with the main combustion chamber 21, and an electrically heatable resistance 24. The resistance 24 is composed, advantageously, of platinum and is anchored in a support 25 composed of aluminum oxide. The support 25 has the form of a pipe and surrounds with a distance the nozzle body 4 and its nozzle holder 13. The ignition chamber 22 is limited by a pipe 25, a coaxial recess 26 in the cylinder head 15 and a further recess 27 which is located in a shaped part 28. The shaped part 28 at its periphery a thread 29 with which it can be inserted from the side of the cylinder head 15 which borders with the main combustion chamber 21, coaxially to the nozzle member 4. The shaped part 28 has an opening 30 in which the nozzle body 4 extends. The ignition chamber 22 is therefore an annular space which is designed so that it is arranged concentrically to the fuel-injection device.

The overflow passages 23 open substantially tangentially to the cross-section of the annular chamber shown in FIG. 1 at its outer periphery. The pipe 25 extends inside a sealing opening 31 which is located in the extension of the thread 14 of the nozzle holder 13 in the cylinder head 15. In direction of the face 16 of the nozzle holder 13, a steam 32 is formed on the pipe 25. The steam 32 has, at a short distance from its end, two recesses 33 and 34. Safety projections 35 and 36 provided on two ring halves 37 and 38 engage in the recesses 33 and 34. The ring halves 37 and 38 are inserted in a circumferential groove 39 formed in the extension of the surface 16 in the nozzle holder 13. Both ring halves 37 and 38 are held by a ring-shaped curved wire bracket 14 relative to one another and relative to the nozzle holder 13.

The intermediate ring 18 surrounds both ring halves 37 and 38 forming a second safety element for the same.

At the height of the steam 32, the nozzle holder 13 has a longitudinal groove 41 through which the steam extends. In longitudinal direction of the steam 32, and also the pipe 25, two conductors 42 and 43 extend. The resistance 24 is connected with both conductors 42 and 43 at the height of the nozzle body 4. The ring halves 37 and 38 have at their upper end lying in the direction of the face 16 a recess 44. A connecting cable 45 extends in the recess 44. It is pressed by the ring halves 37 and 38 against the conductors 42 and 43 and supplies via these conductors the resistance 24 with heating current.

A pipe 46, composed advantageously of a rust-free steel, is arranged between the pipe 25 and the nozzle holder 13 and the nozzle body 4 connected therewith. The pipe 46, which is similarly to the pipe 24 provided with a steam 47 formed thereon and extending through a longitudinal groove 41, is held by projections 35 and 36.

Gaps 48, 49 and 50 are formed inside and outside the pipe 46 between the pipe and the bordering parts 4, 13 and 25.

The pipe 46 carries at the height of the opening 30 an outwardly directed flange 51 which elastically abuts annularly against the opening 30 which is formed as a hollow cone. The nozzle body 4 has an annular groove 52 at the height of the resistance 24. The annular groove 52 is filled with a mineral wool 53 which presses the latter against the pipe 46. This mineral wool 53 serves both as a heat insulation between the nozzle body 4 and the pipe 46, and also as a sealing ring between the main combustion chamber 21 of the internal combustion engine and the gap 49.

Assembly of the injection device 3 and the incandescent ignition arrangement 2 is performed in the following manner. The mineral wool 53 is brought around the nozzle body 4 in its annular groove 52. The pipes 25 and 26 are axially displaced in one another, so that their stems 32 and 47 are in correspondence with each other. After this, both pipes 25 and 26 are displaced with their stems 32 and 47 outwardly over the nozzle body 4, so that the stems 32 and 47 extend through the longitudinal groove 41. After this, the connecting cable 45 is inserted through openings 54 located in the nozzle holder 13 through the conductors 42 and 43. Finally, both ring halves 37 and 38 are introduced along the face 13 into the groove 39, so that the projections 35 and 36 engage in the recess 33 and 34 of the stem 32 and are secured in it in axial direction. The stem 47 is also fixed in the axial direction. The connecting cable 45 is pressed against the conductors 42 and 43 by the ring halves 37 and 38. After pulling over of the wire bracket 40 both ring halves 37 and 38 are held with the wire brackets elastically relative to one another. Now the sealing rings 17, 19 and the ring 18 are displaced over the ring halves 37 and 38. The thus formed unit is inserted and screwed in the cylinder head 15. After this, the shaped part 28 is screwed from the main combustion chamber 21, whereby its opening 30 sealingly lies on the flange 51 of the part 46. If the fuel-injection nozzle 3 and the pipes 25 and 46 mounted thereon must be removed for maintenance work, the shaped part 28 remains in the cylinder head 15.

The injection device 3 operates in a known manner and its description is believed to be unnecessary. It should be mentioned that the fuel-injection can be performed such that it continues or first takes place during the combustion stroke of the internal combustion engine. Fuel injected in the main combustion chamber 21 is then at least partially atomized into droplets in the region connected with the injection nozzle 3. These droplets are mixed in the vicinity of the incandescent ignition arrangement 2 with air which is aspirated in the main combustion chamber 21. During the compression stroke of the internal combustion engine, this mixture of fuel droplets and air flows from the main combustion chamber 21 through the overflow passages 23 in the ignition chamber 22. Since the overflow passages 23 open tangentially in the ring-shaped ignition chamber, it forms finally at the overflow passages 23 a bead-shaped whirl ring 55. It forms thereby a secondary stream and contacts the pipe 25 and the resistance 24. The fuel supplied in the ignition chamber 22 in whirl ring radially accelerates, strikes against the chamber wall and travels inwardly following the secondary stream. Thereby sufficient quantities of fuel reliably arrive at the resistance 24, which also feeds the neighboring part of the pipe 25. The fuel evaporates and forms with flowing-over air an ignition-favorable fuel-air mixture. This mixtures is ignited because of constantly propagating heating by the resistance 24 and the pipe 25, and forms flames. The flames cause an expansion of the mixture accommodated in the ignition chamber 22. Finally, flames strike in form of ignition flames through the overflow passages 23 in the main combustion chamber 21 of the internal combustion engine and ignite there a mixture of air and the injected fuel. The resistance 24 is connected via the connecting cable 45 with a not shown current supply device. The current supply device supplies upon its switching on a heating stream through the resistance 24. After a certain switching time, the resistance 24 and the pipe 25 become heated to a predetermined sufficient temperature for the incandescent ignition. Then the stream can be reduced or at least temporarily turned off. The effective stream action of the resistance 24 can be for example regulated in dependence upon the settings of the ignition relative to the upper dead point of a piston limiting the main combustion chamber 21 of the internal combustion engine. For observation of inflammation or flame generation, known sensors such as ion stream probes or phototransistors and the associated known evaluation systems can be utilized. Such a regulating device is disclosed, for example, in the German Pat. No. 1,545,865. In deviation from the construction shown in FIG. 1, the ignition chamber 22 can be formed entirely as a structural element insertable into the cylinder head. This structural element can be inserted or mounted in the injection nozzle 3 of conventional type from outside of the cylinder head 15. The overflow passages 23 are inclined relative to the longitudinal axis of the injection device. The inclination is selected in dependence upon the design of the main combustion chamber and correspondence to the mixture formation which takes place in the latter. The ignition flames can be so directed that they support at least in the main combustion chamber. The overflow passages 23 can be formed slot-shaped, so that webs remaining therebetween occupy only a small part of the periphery of the ignition chamber 22. The ratio between the sum of the cross-sections of the overflow passages to the volume of the chamber is selected smaller than 0.06 $cm^{-1}$. Thereby a strong pressed stream during charging of the ignition chamber and also strong flames extending into the main combustion chamber during combustion are formed.

Insertion of the ignition chamber in form of a special structural part in the cylinder head 15 provides for the advantage that, by the arrangement of air gaps between the structural part and the cylinder head 15, zones of reduced heat transfer are formed. This leads in a desired manner to a temperature increase of zones of the ignition chamber 22 which are arranged far from the resistance 24 or the pipe 25. As a result of this, the preparation and ignition of the mixture inside the ignition chamber 22 is faster, so that, because of the faster inflammation start and combustion process, time dissipation of the individual inflammation steps and combustion processes is reduced to a narrow range. Thereby the internal combustion engine has a quiet running.

Instead of the meander-shaped resistance 24 shown in FIG. 1, a resistance formed as a two-thread coil can be arranged on the pipe 25. From the manufacturing reasons, such a two thread coil can be applied for example by evaporation or extrusion directly onto the pipe 25 and anchored thereon. The above mentioned manufacturing technique provides for a smooth outer surface in the region of the resistance, on the one hand, and also provides for a good heat transfer on the pipe 25, so that local overheating of the resistance is eliminated, on the other hand.

It will be understood that each of the elements described above, or two or more together, may also find a useful application in other types of constructions differing from the types described above.

While the invention has been illustrated and described as embodied in an ignition arrangement for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An incandescent ignition arrangement for an internal combustion engine having a main combustion chamber and a fuel injecting device with a longitudinal axis, the arrangement comprising means forming an ignition chamber with at least one overflow passage communicating said ignition chamber with the main combustion chamber, said ignition chamber being formed as an annular space coaxial with and surrounding the fuel injection device, said overflow passage raising toward a reference plane extending normal to the longitudinal axis of the fuel injection device and having a component which extends tangentially to a periphery of said annular space and is open into the latter, said overflow passage having an axis and extending to said reference plane at an angle selected so that an extension of the axis of said overflow passage lies inside a fuel ejected from the fuel injection device; and an electrically heatable incandescent ignition means lying inside a contour of said ingnition chamber.

2. An incandescent ignition arrangement as defined in claim 1, wherein said ingnition chamber forming means has a plurality of such overflow passages identical to said first-mentioned overflow passage.

3. An incandescent ignition arrangement as defined in claim 1, wherein a twist stream of combustible mixture acts in the main combustion engine in a direction of rotation, said overflow passage being inclined relative to the reference plane so that an ignition flame emerging therefrom has relative to the longitudinal axis of the fuel injection device a rotary direction corresponding to the direction of rotation of the fuel mixture in the main combustion chamber.

4. An incandescent ignition arrangement as defined in claim 2, wherein said ignition chamber has a longitudinal axis, said overflow passages being distributed around said longitudinal axis of said ignition chamber.

5. An incandescent ignition arrangement as defined in claim 2, wherein said ignition chamber has a predetermined volume, said overflow passages each having a predetermining cross section, a ratio between a sum of the cross sections of said overflow passages and the volume of said ignition chamber being smaller than 0.06 1/cm.

6. An incandescent ignition arrangement as defined in claim 2, wherein a twist stream of a fuel mixture takes place in the main combustion chamber, said overflow passages being arranged so that ignition flames emerging therefrom support the twist stream of fuel mixture in the main combustion chamber.

7. An incandescent ignition arrangement as defined in claim 1, wherein said electrically heatable incandescent ignition means includes at least one resistance member anchored in an insulator.

8. An incandescent ignition arrangement as defined in claim 7; and further comprising an electrically and heat insulated pipe surrounding the fuel injection device, said resistance member being arranged on a periphery of said pipe.

9. An incandescent ignition arrangement as defined in claim 8; and further comprising a ring-shaped closed heat insulating layer arranged at a height of said resistance member between said pipe and the fuel injection device.

10. An incandescent ignition arrangement as defined in claim 9, wherein said heat insulating layer is composed of a mineral whool.

11. An incandescent ignition arrangement as defined in claim 8; and further comprising a further pipe of a poor insulated material, arranged between said first mentioned pipe and the fuel injection device.

12. An incandescent ignition arrangement as defined in claim 11, wherein said further pipe is composed of rust-free steel.

13. An incandescent ignition arrangement as defined in claim 11, wherein at least one of said pipes is arranged so that an air gap is formed between said one pipe and the fuel injection device.

14. An incandescent ignition arrangement as defined in claim 1, wherein the internal combustion engine has a cylinder head, said ignition chamber having been partially formed directly in the cylinder head and partially formed by ring-shaped part arranged in the cylinder head concentrically to the fuel injection device.

15. An incandescent ignition arrangement as defined in claim 14; and further comprising a further pipe of a poor insulated material, arranged between said first mentioned pipe and the fuel-injection device, said further pipe having an end facing toward the main combustion chamber and being provided at this end with a flange, said ring-shaped part having an opening which is concentric to said flange and sealingly borders the latter, said overflow passage being provided in said ring-shaped part.

* * * * *